US010857058B1

(12) United States Patent
Casibang

(10) Patent No.: US 10,857,058 B1
(45) Date of Patent: Dec. 8, 2020

(54) WALKER ASSISTANCE DEVICE

(71) Applicant: Rommel P Casibang, Deptford, NJ (US)

(72) Inventor: Rommel P Casibang, Deptford, NJ (US)

( * ) Notice: Subject to any disclaimer, the term of this patent is extended or adjusted under 35 U.S.C. 154(b) by 0 days.

(21) Appl. No.: 16/747,607

(22) Filed: Jan. 21, 2020

(51) Int. Cl.
*A61H 3/04* (2006.01)
*A61H 3/00* (2006.01)

(52) U.S. Cl.
CPC ..... *A61H 3/04* (2013.01); *A61H 2003/005* (2013.01); *A61H 2201/0192* (2013.01); *A61H 2201/164* (2013.01); *A61H 2205/102* (2013.01)

(58) Field of Classification Search
CPC ..... A61H 3/04; A61H 2003/005
See application file for complete search history.

(56) References Cited

U.S. PATENT DOCUMENTS 2,866,495 A * 12/1958 Diehl ..... A61G 5/0891 297/6
3,596,668 A * 8/1971 Tosto ..... A61H 3/00 135/67
4,722,356 A * 2/1988 Rehder ..... A61H 3/00 135/67
5,086,798 A * 2/1992 Motts ..... A61H 3/00 135/67
5,291,909 A * 3/1994 Skorman ..... A61H 3/00 135/67
5,524,657 A * 6/1996 Jih ..... A61H 3/00 135/66
5,904,168 A * 5/1999 Alulyan ..... A61H 3/00 135/65
6,123,089 A * 9/2000 Fish ..... A61H 3/00 135/67
6,371,142 B1 * 4/2002 Battiston ..... A61H 3/04 135/66
6,595,530 B2 * 7/2003 Wood ..... A61H 3/04 280/42
2012/0048318 A1 * 3/2012 Zendzian ..... A61H 3/04 135/66
2017/0202727 A1 * 7/2017 Wegener ..... A61H 3/04

* cited by examiner

*Primary Examiner* — Noah Chandler Hawk
(74) *Attorney, Agent, or Firm* — Stuart M Goldstein

(57) ABSTRACT

A walker assist device has first and second U-shaped lateral frames with cross bars extending between the frames and through a knee rest control unit. A knee rest is rotatably mounted to the knee rest control unit and is laterally slidable along the cross bars to adjust its position on the cross bars. The knee rest can also be adjusted vertically in relation to the lateral frames for the comfort of the user.

6 Claims, 7 Drawing Sheets

WALKER ASSISTANCE DEVICE

FIELD OF THE INVENTION

The present invention relates to walker assistance devices and specifically to walkers having laterally and vertically adjustable knee rests.

BACKGROUND OF THE INVENTION

Orthopedic assistance devices known as walkers are routinely used by the elderly or those with leg disabilities or leg injuries. A walker is designed such that a user can hold onto handles located on the lateral frames on the device, thus providing assistance to the individual as he or she walks forward or is standing in a stationary position.

A beneficial feature on certain walkers is a knee or seat support. This support provides a surface on which the user can rest his or her leg or even the entire body. Such a support is exemplified in U.S. Pat. No. 6,123,089. However, this and like walker and assistance devices have significant disadvantages. For example, prior devices have knee supports which are cumbersome or awkward to position, making their use by elderly or disabled individuals difficult. Most significantly, knee supports on walker devices are rigidly secured to the walker themselves. They are not adjustable, and, as a result, their functionality is severely limited.

SUMMARY OF THE INVENTION

It is thus the object of the present invention to provide a walker assistance device which addresses and overcomes to disadvantages and limitations of existing devices.

This and other objects are accomplished by the present invention, a walker assistance device having first and second U-shaped lateral frames with cross bars extending between the frames and through a knee rest control unit. A knee rest is rotatably mounted to the knee rest control unit and is laterally slidable along the cross bars to adjust its position on the cross bars. The knee rest can also be adjusted vertically in relation to the lateral frames for the comfort of the user.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
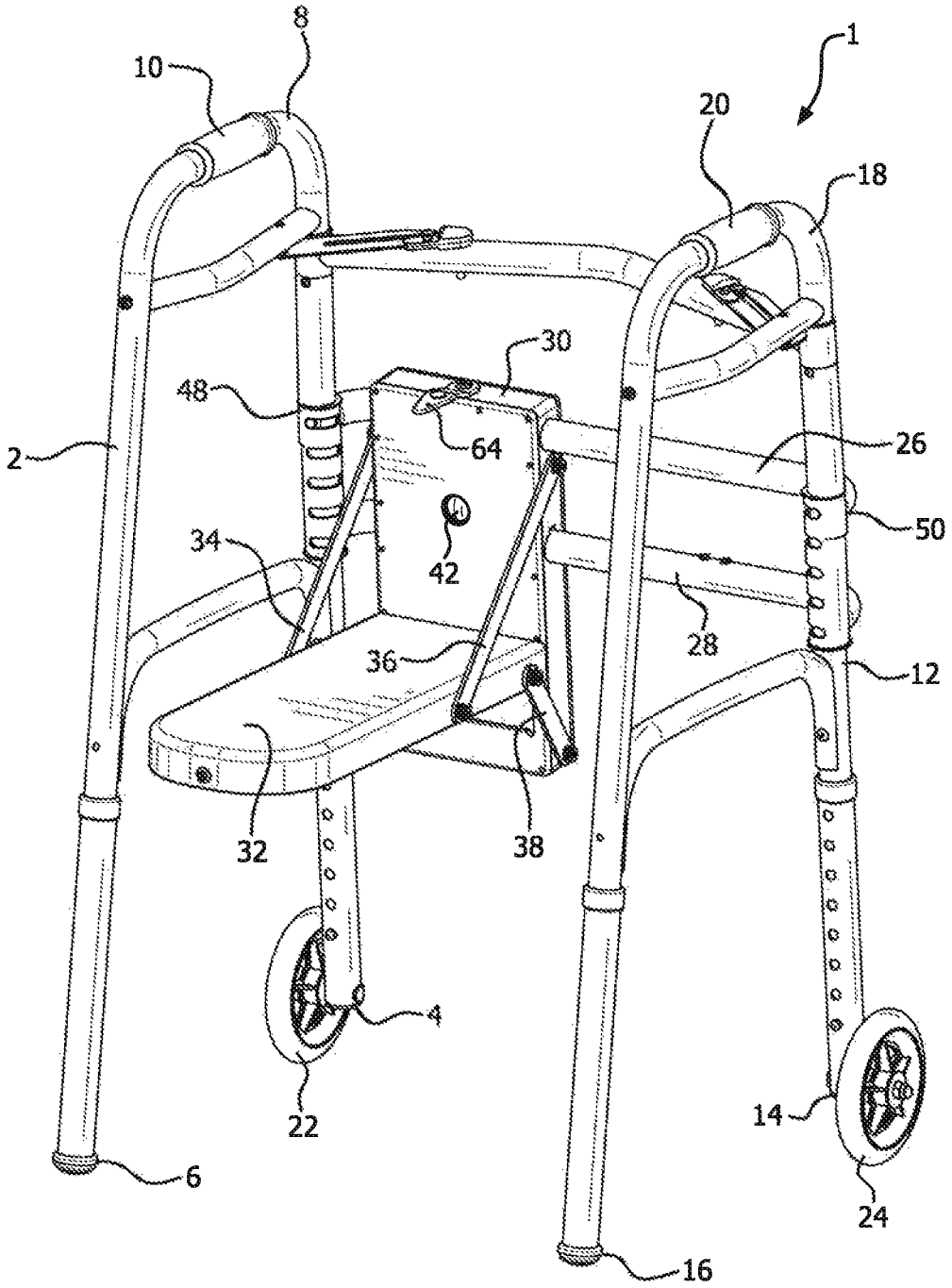
FIG. 1 is a right perspective view of the walker assistance device of the present invention with its knee rest in the left side use mode.

Walker assistance device 1 comprises first U-shaped lateral frame 2 and second U-shaped lateral frame 12. First lateral frame 2 has bottom ends 4 and 6 and top end 8 with handle 10. Second lateral frame 12 has bottom ends 14 and 16 and top end 18 with handle 20. Wheels 22 and 24 are located on bottom ends 4 and 14 of frames 2 and 12. Cross bars 26 and 28 extend horizontally from first frame 2 to second frame 12 and they extend through and support knee rest control unit 30. Knee rest 32 is rotatably mounted to knee rest control unit 30 by means of support bracing members 34, 36, 38, and 40.

Knee rest control unit 40 comprises front plate 41, rear housing 63, push button member 42, intermediate control member 45, and springs 47 and 49. Opening 43 in front plate 41 has a diameter which is greater than the diameter of push button member 42. Notch 51 is inset within the bottom of control member 45. Upstanding tabs 53, 55, 57, and 59 are located on cross bar 28.

Figure 2:
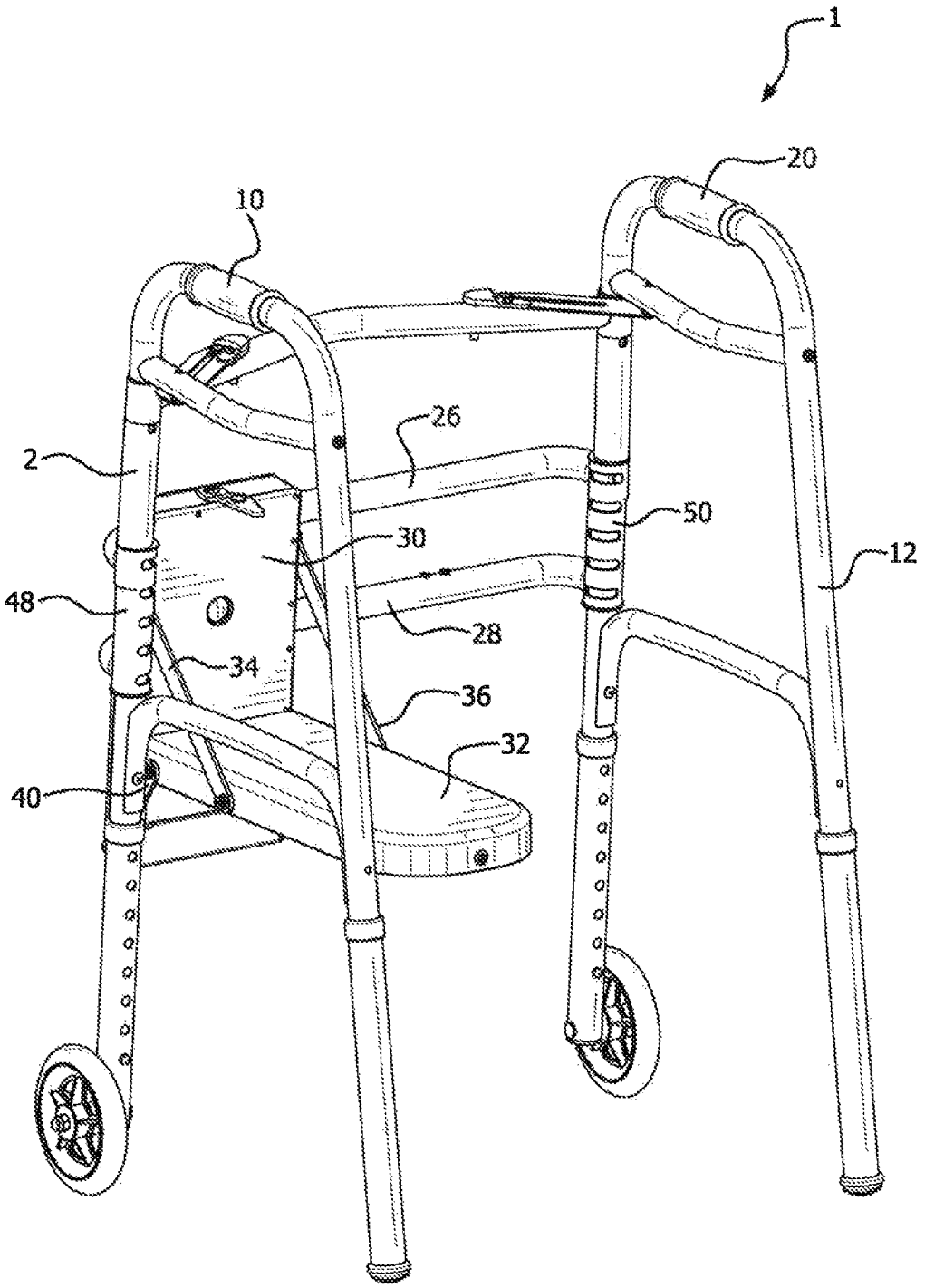
FIG. 2 is a left perspective view of the walker assistance device of the present invention with its knee rest in the left side use mode.

Adjustment means for allowing slidable movement of knee rest control unit 30 along cross bars 26 and 28 comprises push button member 42, control member 45, springs 47 and 49, and tabs 53, 55, 57, and 59 on cross bars 26 and 28. With rest control unit 30 in the left hand use mode shown in FIGS. 1 and 2, notch 51 of control member 45 surrounds and contacts either tab 53 or 55; the control member being forcibly held in place by the bias of springs 47 and 49, thereby securing and immobilizing knee rest control unit 30 in place over cross bars 26 and 28.

Figure 3:
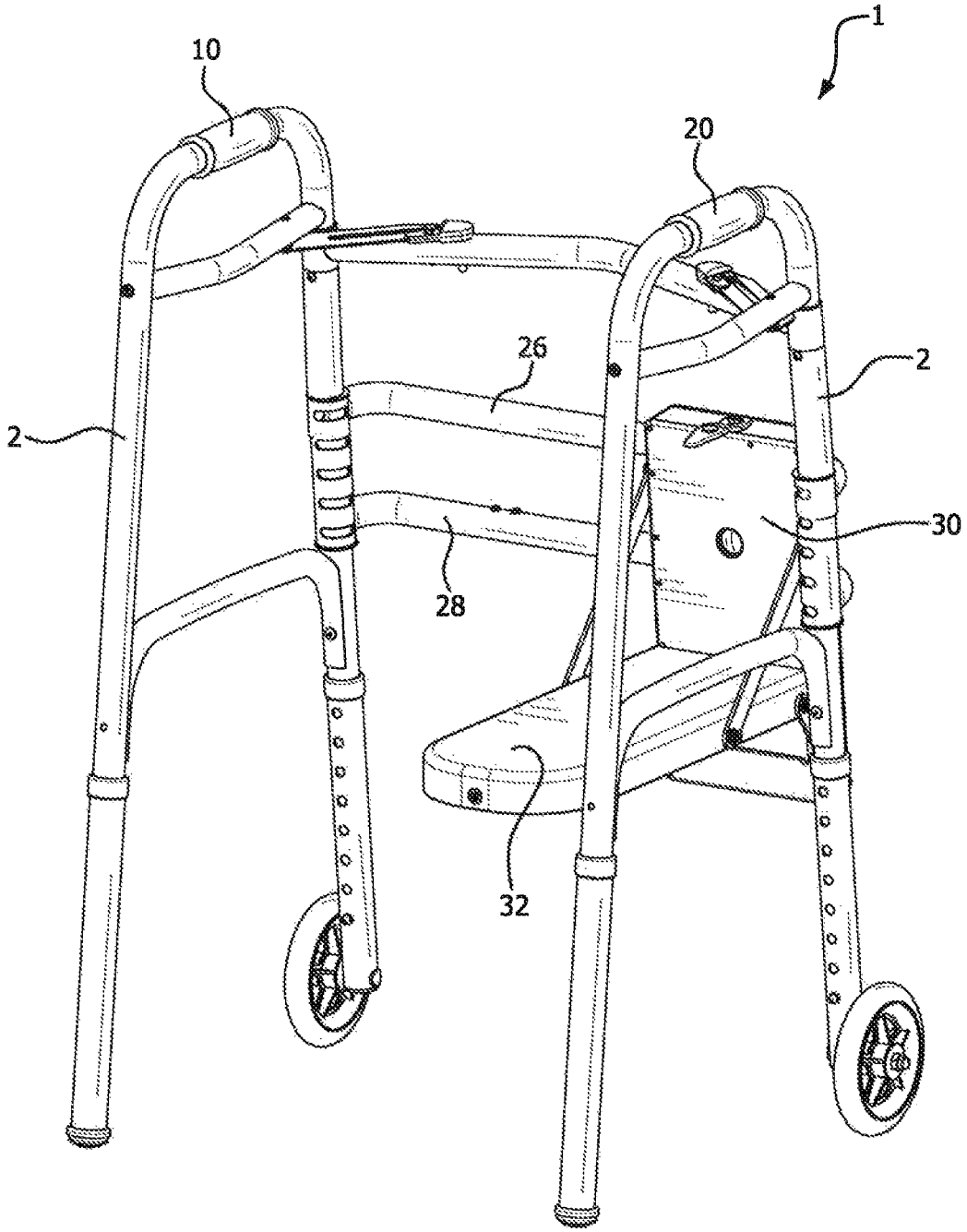
FIG. 3 is a right perspective view of the walker assistance device of the present invention with its knee rest in the right side use mode.
Figure 4:
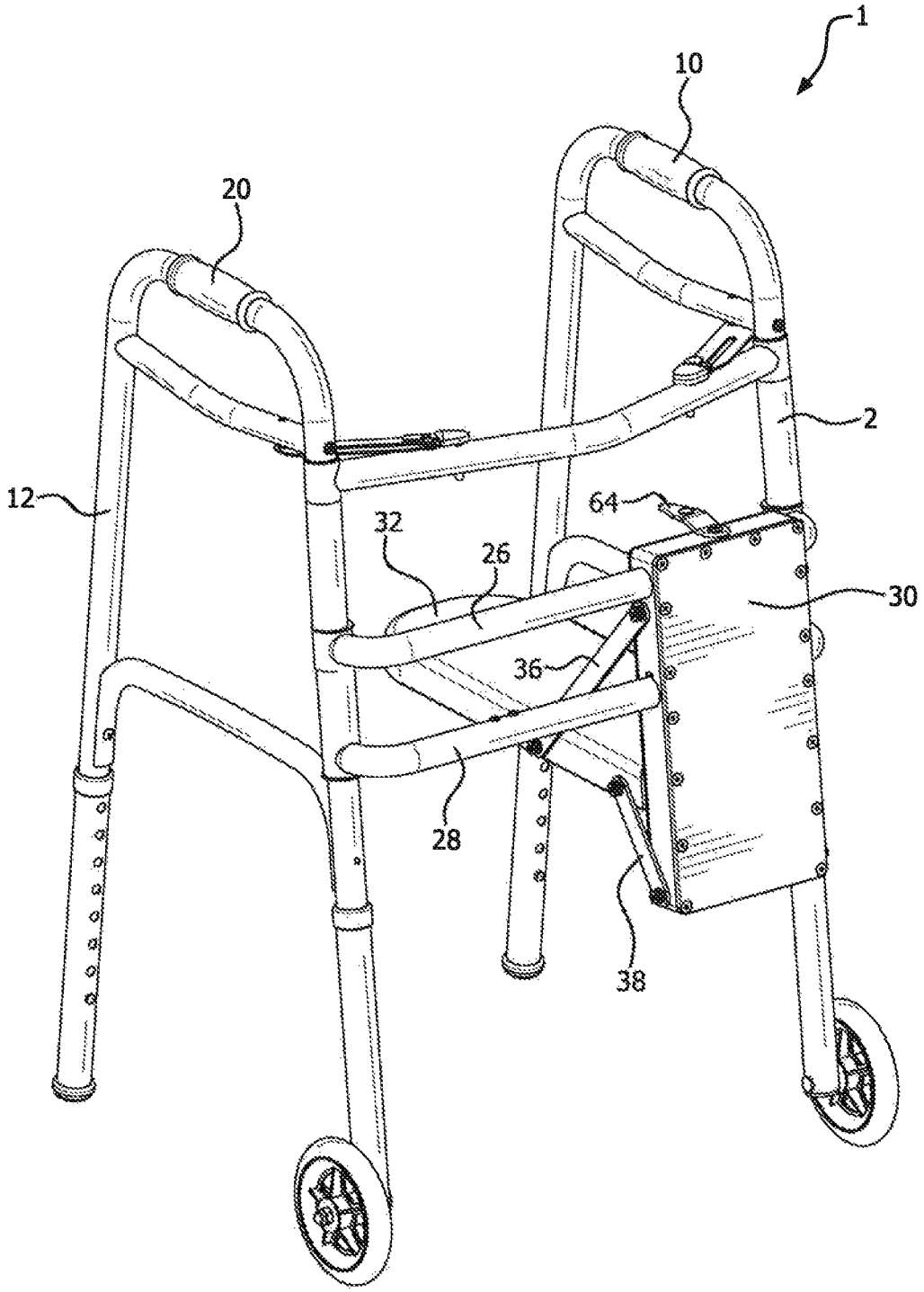
FIG. 4 is a rear perspective view of the walker assistance device of the present invention in its left side use mode.

When button member 42 is pushed through opening 43, control member 45 and its notch 51 are moved inward toward rear housing 63, against the bias force of springs 47 and 49. Notch 51 now no longer surrounds tab 53 (or tab 55, if notch 51 was positioned around this tab). As long as push button member 42 remains pushed and held against control member 45, knee rest control unit 30 can be slid along cross bars 26 and 28 toward the right side of walker assistance device 1. After knee rest control unit 30 is slid to the right side of device 1, as shown in FIG. 3, push button member 42 is released. This causes springs 47 and 49 to expand, thus compelling control member 45 outward, such that notch 51 surrounds and contacts tab 57 or tab 59. Knee rest control unit 30 and knee rest 32 are now secured on the right side of cross bars 26 and 28 of walker assistance device 1. In this manner, the position and movement of knee rest control unit 30 and knee rest 32 is slidably controlled along cross bars 26 and 28.

Figure 5:
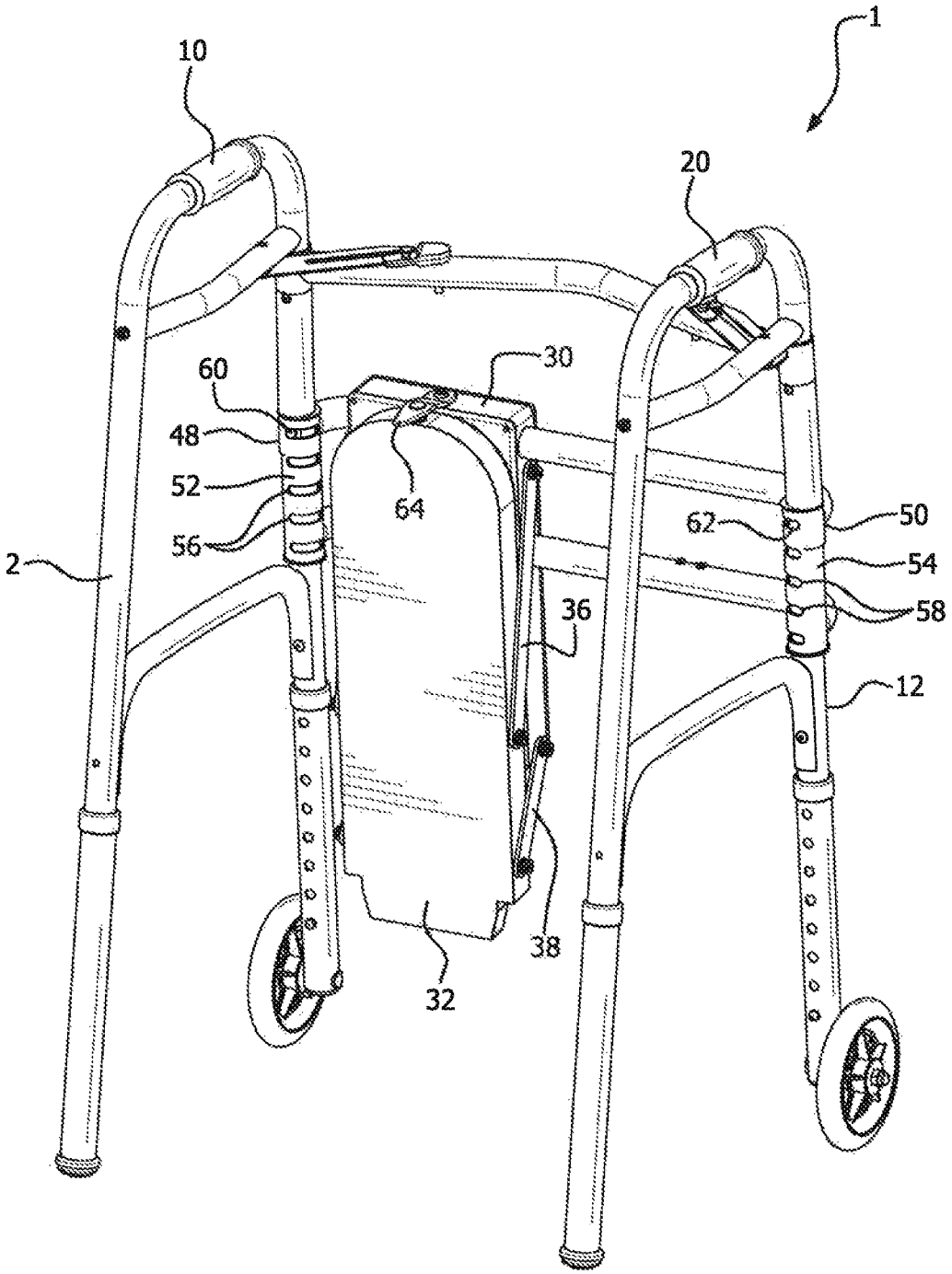
FIG. 5 is a right perspective view of the walker assistance device of the present invention in its stored mode.
Figure 6:
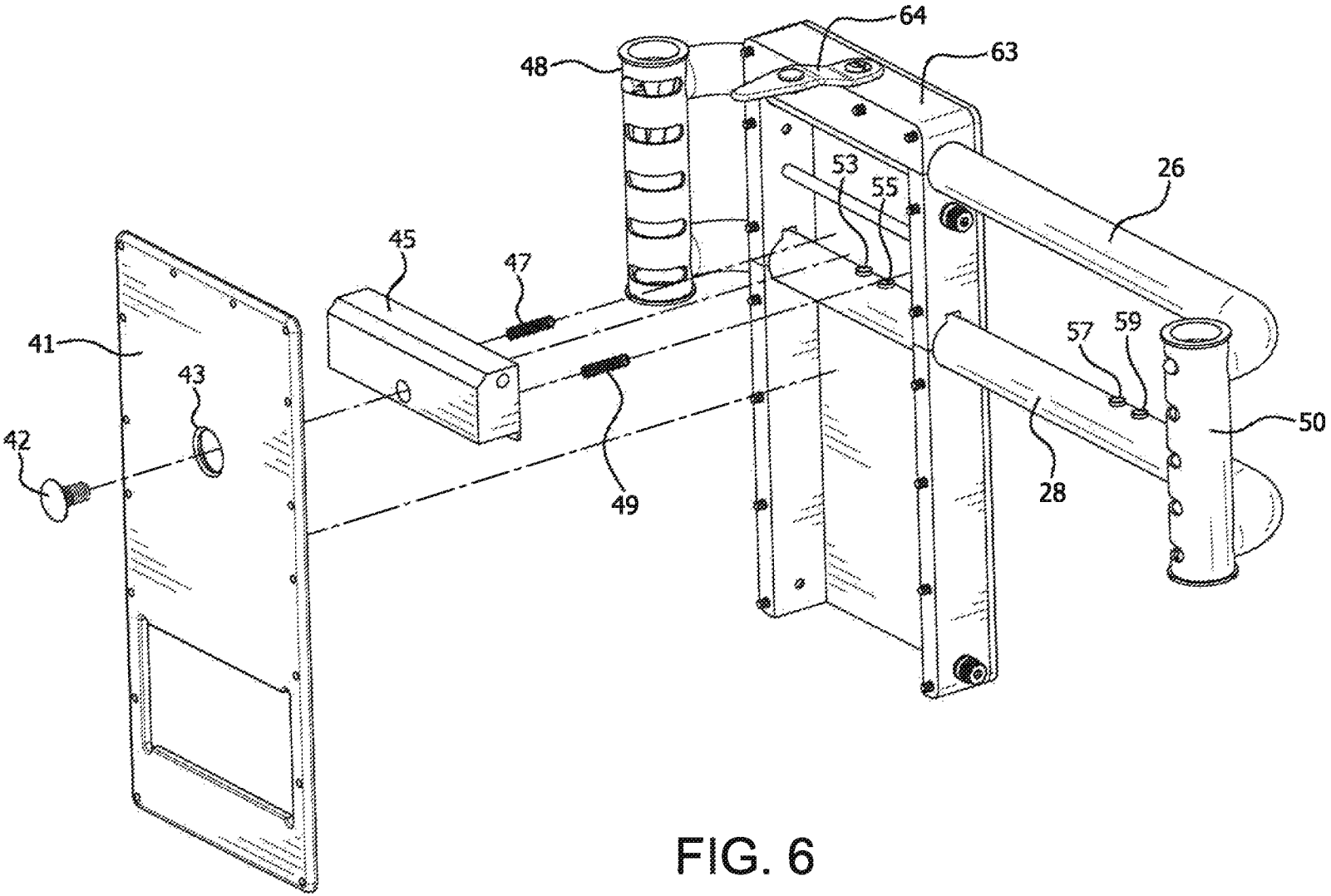
FIG. 6 is an exploded top view of the knee rest control unit of the walker assistance device of the present invention, showing the components of the unit.
Figure 7:
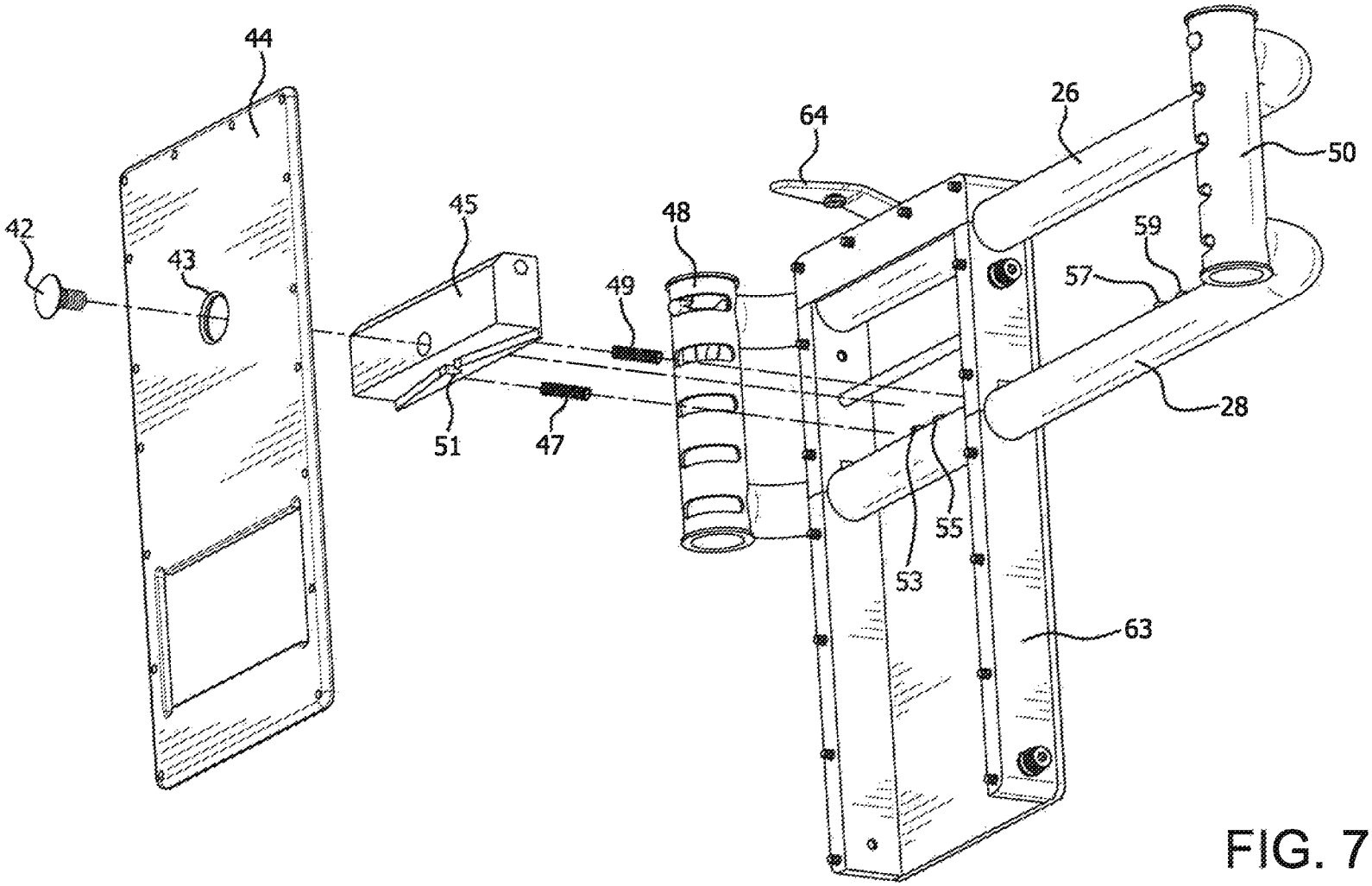
FIG. 7 is an exploded bottom view of the knee rest control unit of the walker assistance device of the present invention.

The vertical position of cross bars 26 and 28 and, hence, the height of knee rest control unit 30 and knee rest 32, is controlled by height adjustment means 48 and 50. The adjustment means comprises cylindrical sleeves 52 and 54 having a plurality of slots 56 and 58, and spring loaded push tabs 60 and 62. FIG. 5 shows cross bars 26 and 28 in a lowered position.

In its stored mode, knee rest 32 is raised so that it is parallel to knee rest control unit 30 and is secured in this position via clasp member 64 located atop the knee rest control unit. See FIG. 5. By releasing clasp member 64, knee rest 32 can be rotated down to its use mode, that is where knee rest is in a lowered position substantially perpendicular to knee rest control unit 30. See FIGS. 1-4. In this use mode, the user can bend his or her leg and position the knee comfortably on knee rest 32 while walker assistance device 1 is moved forward, or the user can actually just sit on the knee rest.

Knee rest 32 can be moved across cross bars 26 and 28 to the opposite side of walker assistance device 1 so that the other knee can be positioned on knee rest 32 by simply pushing button member 42 while sliding knee rest control unit 30 along the cross bars, as previously described. Height adjustment means 48 and 50 are used to accommodate a comfortable height for the individual utilizing walker assistance device 1.

The knee rest device of the present invention is described herein on a standard walker having four legs and dual wheels. However, the device can be utilized on any type of walker and is not to be considered restricted to the walker described herein.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A walker assistance device comprising:

first and second U-shaped lateral frames, each lateral frame having two bottom ends and a top end having a handle;

a knee rest rotatably mounted to a knee rest control unit, wherein in a stored mode the knee rest is raised and is parallel to the knee rest control unit, and in a use mode, the knee rest is lowered, and is perpendicular to the knee rest control unit;

at least one cross bar extending horizontally from the first lateral frame to the second lateral frame and through the knee rest control unit; and adjustment means for slidable movement of the knee rest control unit along the at least one cross bar, said adjustment means comprising a push button member on the knee rest control unit, wherein when the push button member is pressed the knee rest control unit is configured to allow slidable movement of the knee rest control unit along the at least one cross bar.

2. The walker assistance device as in claim 1 comprising two cross bars, each cross bar extending between the lateral frames and through the knee rest control unit.

3. The walker assistance device as in claim 1 wherein the adjustment means further comprises an intermediate control member and at least one biasing spring located in the knee rest control unit, and a plurality of tabs upstanding from said at least one cross bar, wherein the knee rest control unit is immobilized on the at least one cross bar when the control member is in contact with and biased against one of the plurality of tabs, and wherein when the push button member is pressed, the control member is no longer in contact with and biased against said one of the plurality of tabs, allowing the knee rest control unit to slide along said at least one cross bar.

4. The walker assistance device as in claim 3 further comprising a notch, inset within the intermediate control member.

5. The walker assistance device as in claim 1 further comprising height adjustment means to control the height of the at least one cross bar in relation to the lateral frames.

6. The walker assistance device as in claim 1 further comprising a clasp to maintain the knee rest in its stored mode, raised and parallel to the knee rest control unit.

* * * * *